US009169102B2

(12) United States Patent
Bjørnenak et al.

(10) Patent No.: US 9,169,102 B2
(45) Date of Patent: Oct. 27, 2015

(54) DRUM UNIT FOR A WELL INTERVENTION STRING

(71) Applicants: C6 Technologies AS, Stavanger (NO); Stimline AS, Kristiansand (NO)

(72) Inventors: Mads Bjørnenak, Kristiansand (NO); Kenny Armstrong, Stavanger (NO); Tore Aarsland, Nærbø (NO); Erik Zachariassen, Kristiansand (NO); Rune Moen, Kristiansand (NO)

(73) Assignees: C6 Technologies AS, Stavanger (NO); Stimline AS, Kristiansand S (NO)

( * ) Notice: Subject to any disclaimer, the term of this patent is extended or adjusted under 35 U.S.C. 154(b) by 375 days.

(21) Appl. No.: 13/725,633

(22) Filed: Dec. 21, 2012

(65) Prior Publication Data

US 2013/0161441 A1 Jun. 27, 2013

Related U.S. Application Data

(60) Provisional application No. 61/580,116, filed on Dec. 23, 2011.

(30) Foreign Application Priority Data

Dec. 23, 2011 (NO) ..... 20111774

(51) Int. Cl.
*E21B 19/22* (2006.01)
*E21B 17/20* (2006.01)
(Continued)

(52) U.S. Cl.
CPC ..... *B65H 75/4405* (2013.01); *B66D 1/39* (2013.01); *B66D 1/50* (2013.01); *E21B 17/20* (2013.01); *E21B 19/008* (2013.01); *E21B 19/086* (2013.01); *E21B 19/22* (2013.01)

(58) Field of Classification Search
CPC ..... E21B 17/20; E21B 19/008; E21B 19/086; E21B 19/22; B66D 1/39; B66D 3/20; B66D 1/20; B65H 54/2803
USPC ..... 166/77.2; 242/484
See application file for complete search history.

(56) References Cited

U.S. PATENT DOCUMENTS 689,492 A 12/1901 Hughes
2,810,439 A 10/1957 McCullough et al.
(Continued)

FOREIGN PATENT DOCUMENTS

DE 1170126 B 5/1964
DE 199 42 608 4/2001
(Continued)

*Primary Examiner* — Cathleen Hutchins
(74) *Attorney, Agent, or Firm* — Birch, Stewart, Kolasch & Birch, LLP

(57) ABSTRACT

A drum unit for an intervention string for a well includes a drum with a radius for the intervention string, arranged in a structural frame and rotatable by a motor, the drum being arranged translating along a drum axis and driven by a translation motor, for controlled winding of the intervention string onto the drum relative to a first, fixed guide in the structural frame. A compensator includes a guide arch, the guide arch being displaceable in a direction orthogonal to the drum axis using a force device at the structural frame. The intervention string runs between the guide arch and the first fixed guide to or from a first end of the guide arch to the drum. The intervention string runs via a second, opposite end of the guide arch via a second, fixed guide at the structural frame, to or from the well.

18 Claims, 4 Drawing Sheets

(51) Int. Cl.

| | |
|---|---|
| ***B65H 75/44*** | (2006.01) |
| ***E21B 19/086*** | (2006.01) |
| ***E21B 19/00*** | (2006.01) |
| ***B66D 1/39*** | (2006.01) |
| ***B66D 1/50*** | (2006.01) |

(56) References Cited

U.S. PATENT DOCUMENTS

| | | | | |
|---|---|---|---|---|
| 3,524,606 | A | 8/1970 | Coski | |
| 3,690,409 | A | 9/1972 | Brauss | |
| 4,492,363 | A | 1/1985 | Niskin | |
| 4,743,175 | A * | 5/1988 | Gilmore | 417/361 |
| 5,364,043 | A * | 11/1994 | Linderoth | 242/397 |
| 6,006,839 | A | 12/1999 | Dearing et al. | |
| 7,686,073 | B1 * | 3/2010 | Reynolds | 166/65.1 |
| 7,753,344 | B1 | 7/2010 | Moretz et al. | |
| 2003/0010505 | A1 | 1/2003 | Gipson | |
| 2003/0230893 | A1 * | 12/2003 | Song et al. | 285/39 |
| 2004/0118556 | A1 | 6/2004 | Widney | |
| 2004/0188101 | A1 | 9/2004 | Moretz | |

FOREIGN PATENT DOCUMENTS

| | | | |
|---|---|---|---|
| EP | 0 571 207 | A1 | 5/1993 |
| FR | 2 044 130 | A5 | 2/1971 |
| FR | 2843954 | A1 | 3/2004 |
| FR | 2 868 408 | A1 | 10/2005 |
| GB | 1 401 422 | A | 7/1975 |
| GB | 2 296 001 | A | 6/1996 |
| GB | 2457585 | A | 8/2009 |
| JP | 57-141989 | U | 9/1982 |
| JP | 61-277561 | A | 12/1986 |
| RU | 2151264 | C1 | 6/2000 |
| WO | WO 2006/027553 | A1 | 3/2006 |
| WO | WO 2010/117162 | A2 | 10/2010 |

* cited by examiner

DRUM UNIT FOR A WELL INTERVENTION STRING

CROSS REFERENCE TO RELATED APPLICATIONS

This nonprovisional application claims the benefit under 35 U.S.C. §119(e) of U.S. Provisional Application No. 61/580,116 filed on Dec. 23, 2011 and under 35 U.S.C. §119 (a) of Patent Application No. 20111774 filed in Norway on Dec. 23, 2011. The entire content of all of the above applications is hereby incorporated by reference.

INTRODUCTION

The present invention relates to a cable drum for an intervention string. More specifically the invention comprises a cable drum arranged to move axially within a frame in order to keep a constant fleet angle for the winding or unwinding string.

Background Art and Problems Related Thereto

In well intervention operations using a string spooled externally onto drum while using an intervention string laying guide imposing a fleet angle is used. The laying guide shifts the intervention string laterally and imposes a fleet angle on the string. A fleet angle variation with otherwise constant drum rotation speed and string speed usually incurs a tension variation which is undesired. Several of the published patents comprise a drum with a pivotable rotational axis so as for maintaining the cable near the perpendicular line to the drum.

U.S. Pat. No. 3,524,606 Cable reel mounting, describes a drum for lowering and hauling a cable through a set of horizontal guide rollers on top of a vertical pipe. The drum axis is arranged pivotable so as for allowing the cable to run tangentially between the drum and the rollers for all lateral positions of the cable on the drum, so as for reducing fleet angle variation of the cable relative to the drum.

U.S. Pat. No. 3,690,409 describes another pivotable drum arranged for keeping the fleet angle close to the perpendicular line of the drum by shifting the ends of the drum axially while the cable is wound or unwound. An advantage of U.S. Pat. No. 3,690,409 is an increased allowable axial length of the drum and thus an increased cable length capacity.

GB2296001 describes a winch apparatus for deploying or taking in line over a pulley arranged at a distance from the drum. The drum axis is pivotable so as for maintaining the fleet angle of the line near the perpendicular.

WO2006/027553 Richards describes a drum wherein the incoming line runs via a diamond screw controlled line guide which lays the cable with a fleet angle nearly perpendicularly on the drum. The diamond screw controlled line guide allows for the line to be directed parallel with the drum axis.

DE19942608 Becker describes a winch with an axially translating wire drum with a single ply. The axial translation for the wire drum is for guiding the wire in through a fixed entry position of the winch, while the drum is alternating along its axis.

WO2010/117162 also describes such an axially translating drum in a frame with a fixed entry point.

U.S. Pat. No. 7,753,344 to Moretz also describes an axially translating drum in a winch housing with a centrally arranged fixed entry position on the housing.

U.S. Pat. No. 2,810,439 McCullough describes a wellhead winch with an axially translating drum in a winch housing, wherein the winch housing is arranged for being connected under pressure to the wellhead.

EP0571207 describes a winch assembly with a translating drum and a fairlead for guiding the wire onto the drum under a desired fleet angle.

Another problem in the prior art is related to relative speed variations between the drum and the injector head. If we try and stop the intervention string during a hauling operation running the string out of the well, we run the risk of damaging the cable or the injector head very quickly. This is due to the inertia of the different components involved, because the injector head motors move less mass and are much faster to respond than the spooling unit motor which rotates a drum of considerable rotational inertia. Conversely, while feeding the intervention string into the well and suddenly stop it, the rotational inertia of the large drum with its coiled-up string means that it will continue to try and give out cable despite the injector head has already stopped the cable. The usual way of compensating for such speed differences often used in coiled tubing rig ups is to let the coiled tubing travelling through the air, so when they stop quickly the length of the free air arc changes to compensate. However a free travel of the intervention string hanging in an arc between the injector head's gooseneck and the spooling unit may not be desirable both from safety considerations both to operators or mechanical damage, particularly when the distance is large and swinging movements of the sting may be considerable.

If an internal laying drum is used, and the injection head is running the cable into the well and suddenly stops, the inertia of the large drum means that it will continue to try and give out the rigid cable even though the injector head has already stopped. This may damage the cable through longitudinal compression with subsequent buckling or dislocation.

BRIEF SUMMARY OF THE INVENTION

The above problems may be remedied through use of the present invention. The invention is a drum unit for an intervention string, the drum mounted inside a structural frame and arranged to translate laterally relative to the direction of the string, and provided with a tension compensator, so as for allowing straight spooling and compensating for tension variations. More specifically, the invention is defined in the attached claim 1 and is a drum unit (T) for an intervention string (0) for a well, comprising a drum (1) with a radius (R) for said intervention string (0), arranged in a structural frame (2) and rotatable by a motor (22); said drum (1) arranged translating along a drum axis (10) and driven by a translation motor (26), for controlled winding of said intervention string (0) onto said drum (1) relative to a first, fixed guide (4) in said structural frame (2); a tension compensator (3) for said intervention string (0), wherein said compensator (3) comprises a guide arch (31), said guide arch (31) being displaceable in a direction orthogonal to said drum axis (10) using a force device (6) at said structural frame (2); wherein said intervention string (0) runs between said guide arch (31) and said first fixed guide (4) to or from a first end (31A) of said guide arch (31) to said drum (1), wherein said intervention string (0) runs via a second, opposite end (31B) of said guide arch (31) via a second, fixed guide (5) at said structural frame (1), to said well.

Further features of the invention is given in the dependent claims attached.

BRIEF FIGURE CAPTIONS

The invention is illustrated in the attached drawings, wherein

FIG. 1 is an isometric view of a drum unit (T) according to the invention, with an intervention string partly wound up onto the drum. The intervention string is for a well. The drum is arranged laterally displaceable driven by a motor in its axial direction, perpendicularly to the incoming string for laying the string in a controlled way onto the drum, and provided with a compensator for keeping a desired tension level in the intervention string (3) during the running of the drum. The entire drum apparatus is arranged in a steel frame. The intervention string, which may be a carbon fibre reinforced relatively stiff cable, or an ordinary intervention string or coiled tubing, is shown running out (or in) via a guide comprising bend restrictor links outside the frame.

EMBODIMENTS OF THE INVENTION

Figure 1:
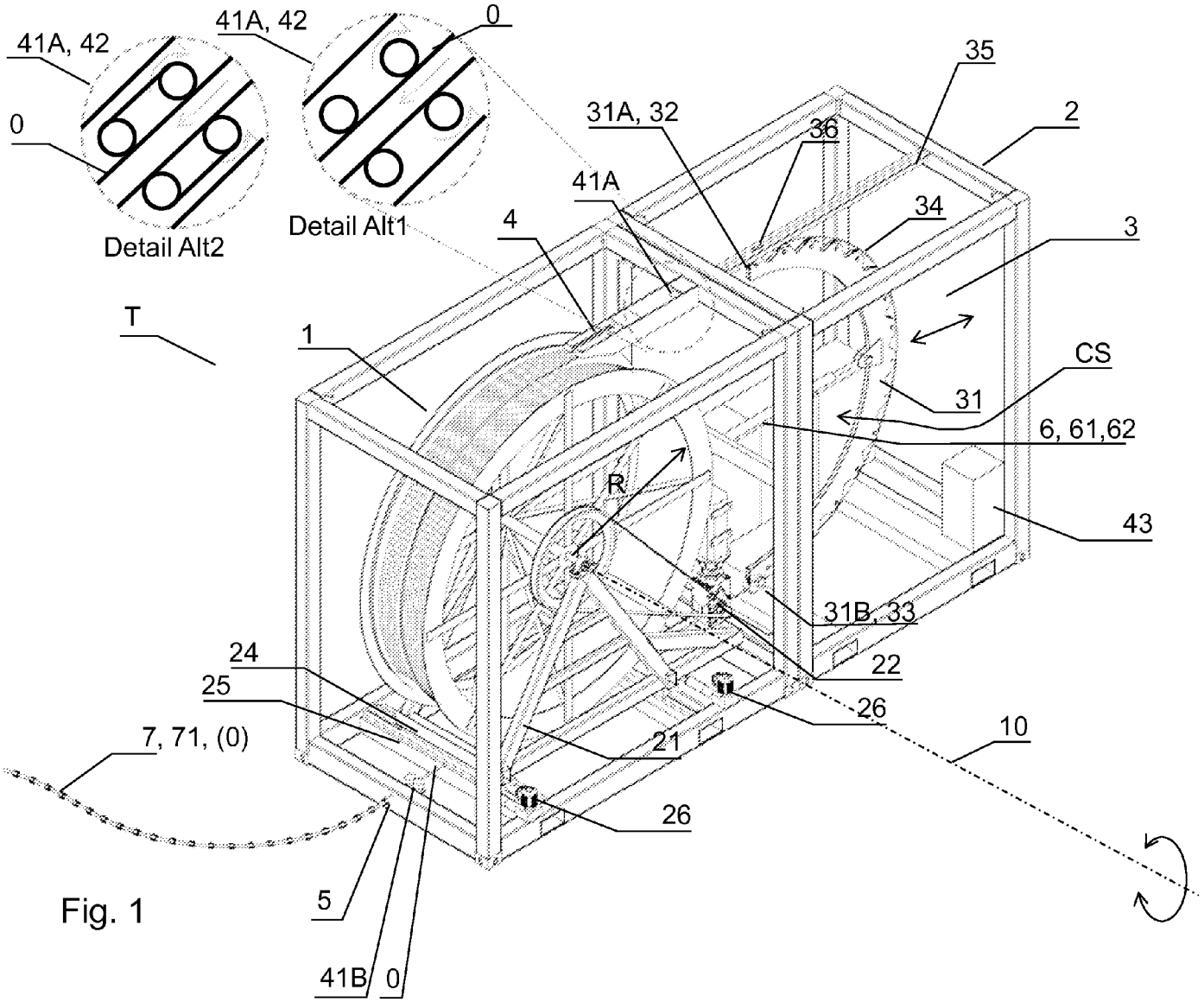
Figure 2:
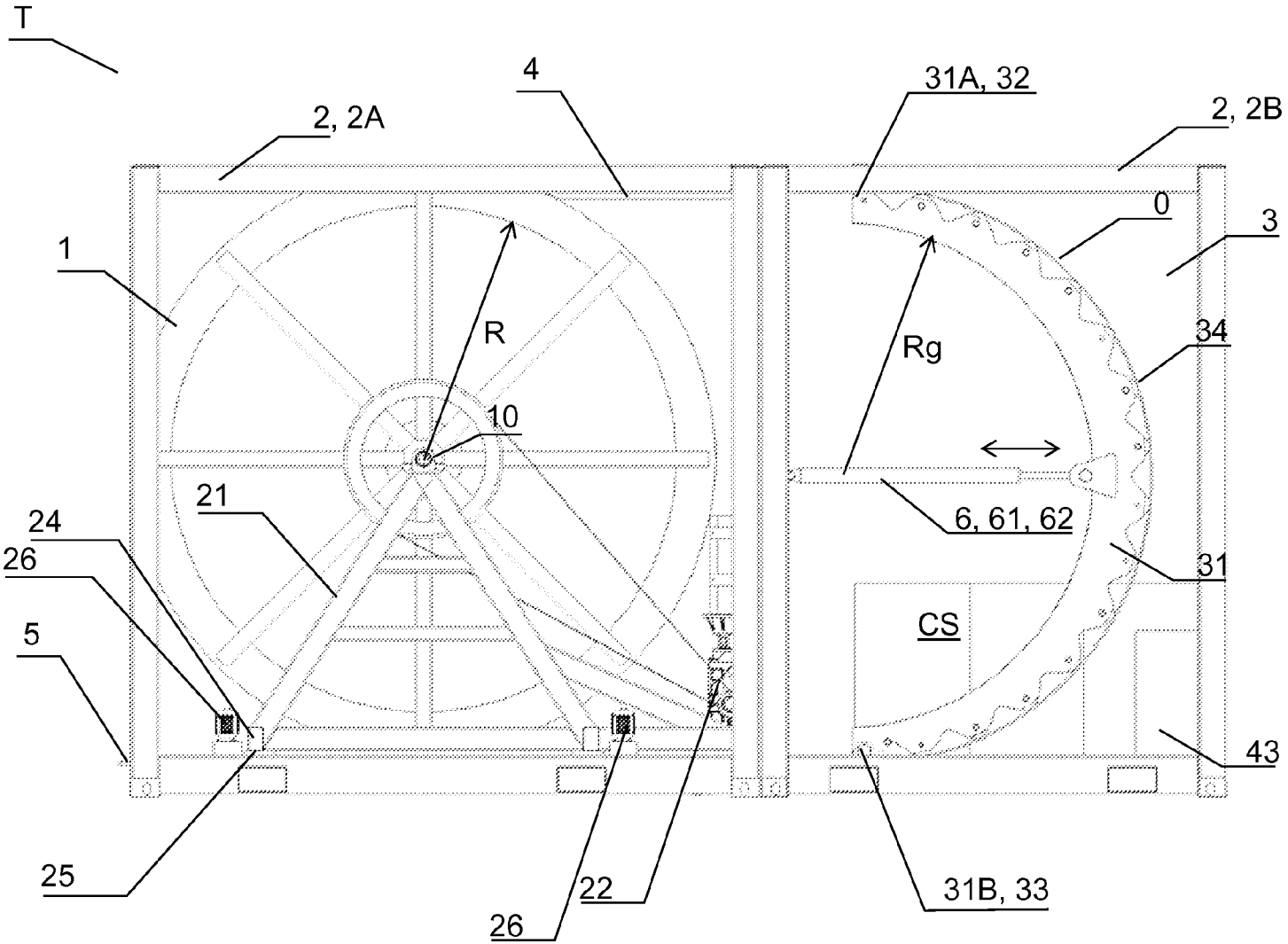
FIG. 2 is a side elevation view of the frame with the drum in the left part shown of the frame, and the compensator shown in the right frame portion. The two frame portions may in an embodiment be split for being transported separately.

The invention is illustrated in FIG. 1 and FIG. 2, a drum unit (T) for an intervention string for a well, in particular a petroleum well. The drum unit comprises the following main features:

- A drum (1) with a radius (R) for the intervention string (0), the drum (1) arranged in a structural frame (2) and rotatable by a motor (22). The drum (1) has a radius (R) equal or larger than a smallest allowable bending radius (R0) for the intervention string. For carbon fibre reinforced intervention rods of radii Ø10 mm to Ø15 mm used by the applicant, the smallest allowable bending radius (R0) may be between 1.4 m and 1.8 m. The diameter of the drum should thus be >=2R0, at least between 2.8 m and 3.6 m. The drum (1) should be accommodated to the largest of these and have a diameter of 3.8 m so the typical height of the frame would be larger than the drum, e.g. 4.2 m. Such a drum may accommodate a cable length of 10 kilometers for a Ø10 mm cable.
- The drum (1) is arranged translating along the drum's axis (10) and the translation is driven by a second translatory motor (26). Thus we achieve controlled winding relative of the intervention string (0) in that the intervention may run in a straight line relative to a first, fixed guide (4) in the structural frame (2) during the laying of the intervention string (0) onto the drum (1). The intervention string avoids shifting laterally to the left and right onto the drum; it is the drum that is displaced laterally in order to receive (or feed out) the intervention string. A lateral angle on the intervention string, which is avoided with the present invention, is called a fleet angle. A fleet angle variation with otherwise constant drum rotation speed and string speed usually incurs a tension variation, and the absence of a fleet angle away from the perpendicular line, and its variation, omits this problem. Such tension variations would otherwise have required that the intervention string had to be operated at a lower maximal tension onto the drum than by the present invention. The alternative of running the drum at a speed varying with the fleet angle is prohibitive if the drum is large.

In order for the drum to be translated in the frame (1) its width should be less than or equal to ½ of the width of the frame. In the present invention an embodiment has a drum width of about ⅓ of the width of the frame; e.g. 0.84 m and 2.5 m, respectively. One may envisage wider drums but then the translating movement of the drum would require the drum and its auxiliary frame to extend outside the frame (2) when at its maximal displacement to either sides of the centreline, which in the preferred embodiment is the plane of the compensator guide arch described below.

- A tension compensator (3) is provided. The tension compensator is for keeping a desired tension in the intervention string (0) during the running of the intervention string onto and out of the drum (1). The compensator tightens the intervention string or yields when speed variations between the injector head's feeding speed and the speed of the drum occur. The drum shall operate as a slave subordinate to the injector head.
- The tension compensator (3) comprises a guide arch (31) for guiding the intervention string (0). The radius (Rg) for the intervention string (0)'s path along the guide arch (31) is larger or equal to the least allowable bending radius (R0) for the intervention string (0). In an embodiment the radius may be the same for the guide arch and for the drum. The guide arch (31) is fixed in the lateral direction of the frame (2) but displaceable to and from the drum, i.e. in a direction orthogonal to said drum axis (10), by means of a "force device" (6) attached to the structural frame (2), i.e. a spring or an actuator or a combination of the two. Other varieties of a force device may be used. In an embodiment of the invention the fixed plane of the guide arch (31) is a central vertical plane through the frame (2) as seen in FIG. 1.
- The intervention string (0) runs between the guide arch (31) and the first fixed guide (4) along its preferably straight path between a first end (31A) of the guide arch (31) and a tangential point on the drum (1), please see the upper part of the guide arch in FIG. 1 or 2.
- The intervention string (0) runs via a second, opposite end (31B) of the guide arch (31) via a second, fixed guide (5) at the structural frame (1), please see the lower left part of the frame in FIG. 1, indirectly to the well.

A result of the cable running in the same plane is that there is no length variations of the running cable section between the fixed point and the tangential point on the drum, and that the cable runs straight during the winding and unwinding. Bending of the cable is avoided, but more importantly one avoids the variations in tension with varying fleet angle. Further, the cable is not being forced into position; instead the drum is moving to the appropriate position to facilitate the correct desired spooling pattern of the string member.

Figure 4:
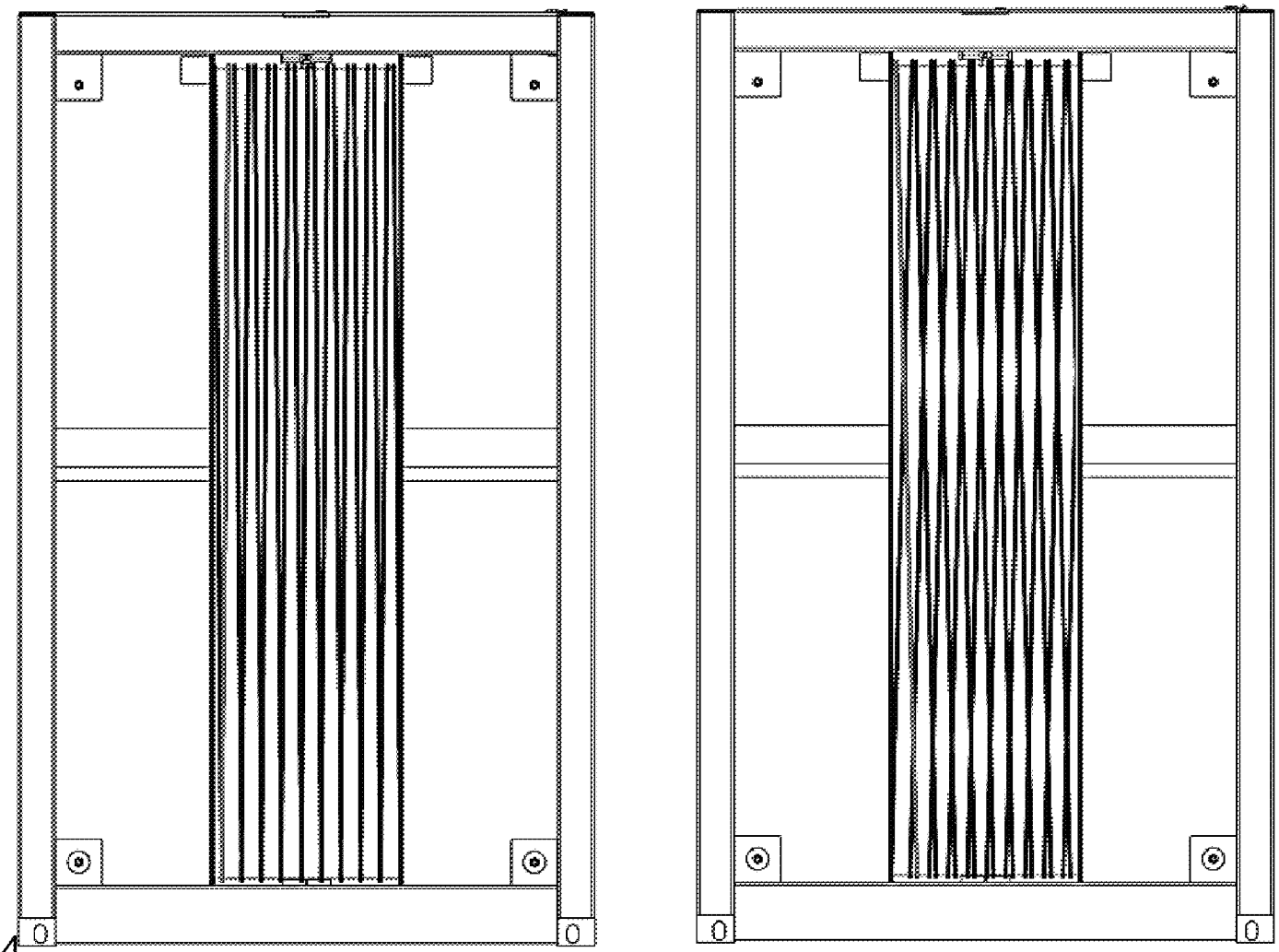
FIG. 4 shows end views with two different layup patterns on a drum according to the invention.

In a preferred embodiment of the invention the drum is an external laying drum, as shown in the drawings. The laying pattern may be plain, side by side without any crossings as illustrated in FIG. 1 for fully utilizing the capacity of the drum, or laid in a braided pattern with one or more crossings per revolution if another pattern is desired, as illustrated by two examples in FIG. 4.

In an embodiment of the invention the guide arch (31) is arranged linearly displaceable, i.e. it translates to and from the drum. In another embodiment it is displaceable by being pivoted about a first, upper or second, lower axis (32, 33) arranged in the frame (1). In FIG. 1 is shown an upper guide rail (35) for a guide pin (36) protruding from the top of the guide arch (31), and which is used in the embodiment wherein the guide arch pivots about the second, lower axis (33). The guide rail (35) may alternatively be arranged in the lower part of the frame if the pivot axis (32) at the top is used.

In yet another embodiment of the invention guide arch (32) may be constituted by a rotating sheave wheel that can translate back and forth. An advantage of using a 180 degrees arch (32) as shown in FIG. 1 and FIG. 2 is the considerably reduced space requirement compared to a full sheave.

The force device (6) may in an embodiment of the invention comprise a spring mechanism (61). The force device (6) may alternatively or in addition to a spring mechanism comprise a pneumatic, hydraulic or electrical actuator (62). In FIG. 1 and FIG. 2 a hydraulic piston embodiment is shown.

The drum (1) is according to an embodiment arranged in bearings on an auxiliary frame (21), preferably with skids (24) arranged to run along transverse rails (25) arranged in the structural frame (1). Further, the auxiliary frame (21) is arranged to be driven in both directions parallel with the drum axis (10) along the rails (25) by means of one or more translation motors (26) with telescoping actuators acting to the auxiliary frame (21). The translation motors (26) may be arranged on the frame (2) as shown in FIGS. 1 and 2.

The drum unit according to the invention is in an embodiment provided with one or more string tension feeder units (41, 41A, 41B) arranged on the structural frame (2). The string tension feeder units exert at least a minimally required tension on the intervention string (0) outwardly directed from said drum (1) and are arranged for feeding the intervention string (0) in a desired direction outwardly from or inwardly to said drum (1). The tension feeder unit (41) shall preferably be employed during rigging and connection to the injector head (8). When the injector head on the well has received the intervention string (0) the tension feeder units may be set in freewheel mode or disconnected. However, the tension feeder units may be operated during feeding out the rather stiff intervention string from the drum in order to prevent the string from raising off the drum. Speed differences between the drum and the string would be taken up by the compensator guide arch of the invention anyway.

According to an embodiment of the invention a tension feeder unit (41B) is arranged by the second fixed guide (5), please see FIG. 1.

This will allow the end of the intervention string, or a whip attached to the end of the string, to be held at this point of the frame structure when the intervention string is hauled in all the way to the frame (2). This tension feeder unit (41B) may operate alone and may hold an outer end or "whip" of the intervention string (0) by said frame (2) when the intervention string (0) is entirely coiled in onto the drum. Then, however, the structural frame (2) may not be split into two parts, a drum frame (2A) and a compensator frame (2B) because the whip or outer end of the intervention string (0) still is laid around the guide arch (31) and locks it in place.

However, if the whip or outer end of the intervention string is allowed to be pulled further in onto the drum and locked in a first tension feeder unit (41A) at the drum frame (2A), further in relative to the guide arch (31), the guide arch (31) and the compensator frame (2B) are free may and may be disconnected, please see below. Then the structural frame (2) may be disassembled into a drum frame (2A) and a compensator frame (2B) and allow them to be transported as two parts.

In an embodiment of the invention the first tension feeder unit (41A) is arranged at said first fixed guide (4).

The tension feeder unit (41A, 41B) may in an embodiment comprise two motorised rollers or belts (42) oppositely arranged on either sides of said intervention string's (0) path and arranged for gripping and exerting a longitudinally directed force on said intervention string, please see the insert detail in the upper left portion of FIG. 1.

Braking using the motorised rollers or belts will generate heat irrespective of the motorised rollers use hydraulic or electric energy. As the brakes are small and there is a risk that they must brake for extensive lengths, large amounts of heat may be generated. The heat generated by the braking may be taken out in a brake resistor (43) which may dissipate the heat.

Figure 3:
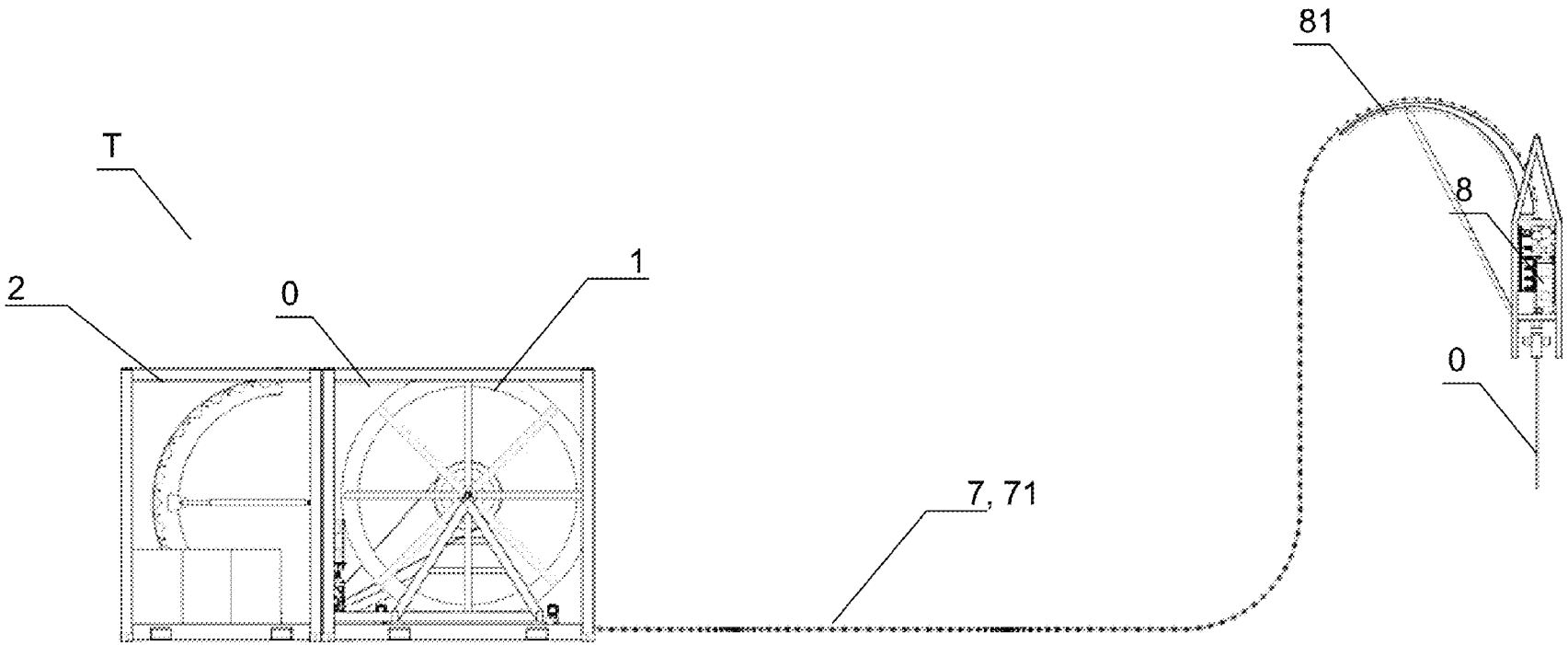
FIG. 3 is a side elevation view of the frame, the drum and the compensator, with the closed guideway comprising bending restrictors laid horizontally and over a gooseneck to an injector head on a well.

In an embodiment of the invention, an intervention string guide channel (7) of fixed length may be arranged between the second fixed guide (5) and an injector head (8) on said well, please see FIG. 3. The guide channel may comprise at least two bend restrictors (71) for the intervention string (0). The guide channel (7) including the bend restrictors (71) is preferably closed due to safety reasons. This has clear advantages; personnel and cranes cannot interfere directly with any running intervention string. The guide channel (7) may advantageously comprise pipes of fixed shape in combination with bend restrictors. In this manner the drum unit may be placed far from the injector head and the guide channel may be laid along deck and guided along inclined paths through fixed pipe sections without requiring much space along its path. The guide channel (7) may advantageously be lined with a Teflon pipe in order to reduce friction and wear.

As an alternative to the use of the drum unit being placed separate from the wellhead injector as shown in FIG. 3, in an embodiment of the invention the drum unit may be connected directly on the well so as for the intervention string to run directly from said fixed guide (5) of the structural frame (2) to the injector head (8), i.e. that the structural frame (2) to be arranged directly above the injector head (8).

The intervention string (0) is a relatively rigid fibre reinforced cable (01) or a coiled tubing (02) or an otherwise slick metal string (03). The intervention string may comprise an electrical conductor, a fluid communication line, a signal fibre, or combinations of two or all of those.

The drum unit illustrated in FIG. 1 has a typical length of 7.14 m, a height of 4.20 m, and a width of 2.49 m. The total length of the unit may prove impractical for transport. In an embodiment the drum unit's structural frame (2) is assembled from a drum frame (2A) and a compensator frame (2B) which may be disconnected and reassembled.

The guide arch (32) is in an embodiment of the invention provided with a series of small sheaves (34) along its radially outward facing arch length for supporting and guiding the intervention string (0). The sheaves guide the intervention string and reduces friction between the string and the guide arch. As the string runs externally along the arch on the sheaves the arch must keep the intervention string in a tension sufficient for the string to bend into the bending radius of the intervention arch. This is obtained using the force device (6) to take up any slack of the string.

As mentioned above, the compensator must tighten the intervention string or yield when speed variations occur between the injector head's feeding speed and the speed of the drum occur. Further, the drum shall operate as a slave subordinate to the injector head. To achieve this, the drum unit is in an embodiment provided with a control system (CS) arranged for receiving control signals from a higher order control system for the injector head (8) on the wellhead. The higher order control system commands feeding down, halting, or hauling up the intervention string. Further, the control system sets the speed required for the intervention string (0). The control system is arranged for coordinating the movements of the intervention string on the drum (1) with the movement of the intervention string running through the injector head (8). As the two have different inertia, differences during injection and hauling are taken up by using the compensator. After having compensated for a reduced tension in the string due to high rotational inertia of the drum and coiled-up string when the injector head suddenly reduces its speed, the compensator arch is run outwardly relative to the drum axis. If, conversely, the injector head increases its injection speed, the compensator arch may be allowed to run inwardly in order for allowing the drum to catch up, and subsequently the compensator arch is returned to near a neutral middle position in order for meeting a subsequent need for slacking or tensioning the string.

The above described embodiments may all be combined except when mutually exclusive. An example of mutually exclusive combinations is the fact that a rigid guide arch (31) cannot be arranged pivotable about both the upper and the lower axis (32, 33) at the same time, because it would lock the guide arch in place.

As mentioned under the initial presentation of problems related to prior art, problems caused by relative speed variations between the drum and the injector head may be remedied using a free hanging cable between the gooseneck and the drum. However, the inertia problems become more apparent if a string channel of fixed length outside the wellhead, e.g. with a series of bend restrictors is used, because this creates a fixed distance between the spooling unit and injector head, and this requires compensation for speed variations. In such situations the tension compensator of the invention becomes a significant advantage.

The present invention has been indicated as a drum unit (T) for an intervention string (0) for a well. First and foremost a petroleum well is the intended area of use, but a geothermal well or a water well is also possible.

The invention claimed is:

1. A drum unit for an intervention string for a well, comprising:

a drum with a radius for said intervention string, arranged in a structural frame and rotatable by a motor, said drum being arranged for translating along a drum axis and driven by a translation motor, for controlled winding of said intervention string onto said drum relative to a first, fixed guide in said structural frame;

a tension compensator for said intervention string, wherein said compensator comprises a guide arch, said guide arch being displaceable in a direction orthogonal to said drum axis using a force device at said structural frame, wherein said intervention string runs between said guide arch and said first fixed guide to or from a first end of said guide arch to said drum, and runs via a second, opposite end of said guide arch via a second, fixed guide at said structural frame, to or from said well, directly or indirectly, and wherein an intervention string guide channel with at least one bend restrictor for said intervention string is arranged between said second, fixed guide and an injector head on said well, and said intervention string guide channel comprises pipes of fixed shape in combination with said at least one bend restrictor.

2. The drum unit of claim 1, wherein said guide arch is arranged linearly displaceable.

3. The drum unit of claim 1, wherein said guide arch is pivotable about a first, upper or second, lower axis in said structural frame.

4. The drum unit according to claim 1, wherein said force device comprises a spring mechanism.

5. The drum unit according to claim 1, wherein said force device comprises a pneumatic, hydraulic or electrical actuator.

6. The drum unit according to claim 1, wherein said drum is arranged in bearings on an auxiliary frame, comprising skids arranged to run along rails arranged in said structural frame, wherein said auxiliary frame is arranged to be driven in both directions parallel with said axis by means of said translatory motor.

7. The drum unit according to claim 1, further comprising one or more string tension feeder units arranged on said structural frame for exerting at least a minimally required tension on said intervention string outwardly directed from said drum and arranged for feeding said intervention string in a desired direction outwardly from or inwardly to said drum, the one or more string tension feeder units including a first tension feeder unit and a second tension feeder unit.

8. The drum unit according to claim 7, wherein the first tension feeder unit is arranged at said second fixed guide.

9. The drum unit according to claim 7, wherein the second tension feeder unit is arranged at said first fixed guide.

10. The drum unit according to claim 7, wherein each of the one or more string tension feeder units comprises two motorised rollers or belts oppositely arranged on either sides of said intervention string's path and arranged for gripping and exerting a longitudinally directed force on said intervention string.

11. The drum unit according to claim 1, wherein said intervention string is a slick metal string, a relatively rigid fibre reinforced cable or a coiled tubing.

12. The drum unit according to claim 1, wherein said structural frame is assembled from a drum frame and a compensator frame.

13. The drum unit according to claim 1, wherein said guide arch is provided with a series of sheaves along said guide arch for supporting and guiding said intervention string.

14. The drum unit according to claim 1, further comprising a control system arranged for receiving control signals from a higher order control system for said injector head on a wellhead, said higher order control system being arranged for commanding feeding down, halting or hauling up and setting a speed of said intervention string, and arranged for coordinating said drum with said injector head.

15. The drum unit of claim 1, wherein said radius of the drum is equal or larger than a smallest allowable bending radius.

16. The drum unit of claim 1, wherein said guide arch has a radius larger or equal to said least allowable bending radius.

17. The drum unit of claim 1, wherein the drum is an external laying drum.

18. The drum unit of claim 1, wherein a width in an axial length direction of said drum is one third of a width of said frame measured along said axis.

* * * * *